US011344907B2

(12) United States Patent
Thompson

(10) Patent No.: US 11,344,907 B2
(45) Date of Patent: May 31, 2022

(54) SELF POWERED METHOD AND APPARATUS FOR VARIABLE DISPLAY FOUNTAIN JETS

(71) Applicant: Bruce A. Thompson, Granite Bay, CA (US)

(72) Inventor: Bruce A. Thompson, Granite Bay, CA (US)

(73) Assignee: Brue A. Thompson, Granite Bay, CA (US)

( * ) Notice: Subject to any disclaimer, the term of this patent is extended or adjusted under 35 U.S.C. 154(b) by 249 days.

(21) Appl. No.: 16/876,058

(22) Filed: May 17, 2020

(65) Prior Publication Data

US 2021/0354163 A1 Nov. 18, 2021

(51) Int. Cl.
*B05B 17/08* (2006.01)
*B05B 1/16* (2006.01)

(52) U.S. Cl.
CPC ..... *B05B 17/08* (2013.01); *B05B 1/169* (2013.01); *B05B 1/1672* (2013.01)

(58) Field of Classification Search
CPC ..... B05B 1/1672; B05B 1/169; B05B 17/08
See application file for complete search history.

(56) References Cited

U.S. PATENT DOCUMENTS 3,570,764 A * 3/1971 Inoue ..... B05B 17/08 239/22
5,524,822 A * 6/1996 Simmons ..... B05B 17/08 137/625.11
7,571,496 B2 * 8/2009 Martin ..... E04H 4/169 239/206
9,108,206 B1 * 8/2015 Bredberg ..... B05B 1/169
2006/0261189 A1 * 11/2006 Amron ..... F41B 9/0018 239/380
2012/0126029 A1 * 5/2012 Koetsier ..... B05B 3/0427 239/242
2021/0015247 A1 * 1/2021 Wu ..... A46B 11/063

* cited by examiner

*Primary Examiner* — Ryan A Reis

(57) ABSTRACT

A method and apparatus for providing a self-powered variable fountain display is disclosed. A high-pressure source of water is applied to a bifurcated manifold. A first portion of the manifold supplies a distribution chamber within which is a plurality of distribution holes, each of which is capable of driving an individual fountain display nozzle. A second portion of the manifold provides motive power to an impeller that in turn drives a gear system used to select which of the plurality of distribution holes is active.

18 Claims, 4 Drawing Sheets

SELF POWERED METHOD AND APPARATUS FOR VARIABLE DISPLAY FOUNTAIN JETS

This is a non-provisional application for utility patent within the meaning of 35 USC 111(a).

BRIEF DESCRIPTION

A method and apparatus for providing a self-powered variable fountain display is disclosed. A high-pressure source of water is applied to a bifurcated manifold. A first portion of the manifold supplies a distribution chamber within which is a plurality of distribution holes, each of which is capable of driving an individual fountain display nozzle. A second portion of the manifold provides motive power to an impeller that in turn drives a gear system used to select which of the plurality of distribution holes is active.

BACKGROUND OF THE INVENTION

Water features are a part of traditional as well as contemporary architecture. Throughout history, water features have included fountains. From ancient times to the present, many fountains have had multiple spouts, many with different types of spouting display such as a fan or an arch.

Contemporarily, these multiple pattern, or variable pattern spouting displays use one of two methods. As discussed just below, each of these methods has advantages and disadvantages. Common to both are complexity and expense factors involving plumbing, wiring, controller means, and safety.

The first method employs multiple valves connected to a single high-pressure manifold. Each of the multiple valves is located at some point in or near the fountain and each is wired to a controller of some sort that causes each of the valves to be opened according to some preset program. In order to operate such a system, a series of valves and cables must be routed from the controller to the fountain, presenting, among other issues, a safety problem related to the proximity of electricity to water. An added disadvantage of this method is the need for some level of expertise to program the controller.

The second method also employs multiple valves, but the valves are centrally located. From a high-pressure manifold, a hose or pipe is run to each of the valves. As with method one, a preset program determines which of the valves open. While this method eliminates the safety issue from the above, the complexity, expense of the plumbing and programming are disadvantages.

Added to the disadvantages of the above methods is the inability of private property owners to access variable pattern fountain displays due to expense and complexity. The result is that only commercial properties or wealthy private property owners can utilize such equipment.

What would be desirable is a method and apparatus that eliminates the complexity and expense of the contemporary methods while simultaneously making such an apparatus affordable to small, private properties. Even more desirable would be an apparatus that does not depend on an outside control mechanism or source of power to activate the variable pattern spouting displays.

SUMMARY OF THE INVENTION

A method and apparatus for providing a self-powered variable fountain display is disclosed. A high-pressure source of water is applied to a bifurcated manifold. A first portion of the manifold supplies a distribution chamber within which is a plurality of distribution holes, each of which is capable of driving an individual fountain display nozzle. A second portion of the manifold provides motive power to an impeller that in turn drives a gear system used to select which of the plurality of distribution holes is active.

High pressure water from some source, for example a pressure pump or high-pressure city water line, is connected to a bifurcated manifold. The bifurcated manifold is comprised of two delivery tubes: a first, larger diameter delivery tube provides water to a distribution chamber and a second, smaller delivery tube provides motive power to an impeller within an impeller chamber. The smaller delivery tube is tapered to take advantage of Bernoulli's Principle, allowing the incoming water to increase in velocity to drive the impeller.

The distribution chamber contains a driven gear that has a feed orifice, or slot along its outer perimeter which allows water within the distribution chamber to be passed to one of a plurality of individual fountain display jets. The driven gear rotates in response to engagement with a driving gear also located in the distribution chamber, but driven by the impeller through a sealed shaft from the impeller chamber. As the driven gear rotates, the driven gear slot passes over one of a plurality of holes, each hole connected to a hose or some other delivery mechanism that in turn directs water to a specific fountain display jet. Each of the fountain display jets may have a distinct display pattern and may or may not be collocated.

Both the distribution chamber and the impeller chamber are contained within the same physical structure, but separated from each other by a pressure wall. The pressure wall is necessary because the separate chambers have different pressures associated with their operation. The impeller chamber operates under the influence of compressed water at a higher velocity in the smaller delivery tube, thus the pressure in the impeller chamber cavity will be lower than the pressure in the distribution chamber. To maintain these differing pressures, the impeller chamber has a separate exhaust port that allows water to escape after passing by the impeller.

Since the distribution chamber and the impeller chamber are physically isolated, a drive shaft connects the impeller to the drive gear through a water-tight seal passing through the isolation wall between the chambers. In this way the impeller provides rotational force to the drive gear which them rotates the driven gear.

The method and apparatus of the present invention is detailed below in conjunction with the drawings listed just below.

DETAILED DESCRIPTION OF THE PREFERRED EMBODIMENTS

Figure 1:
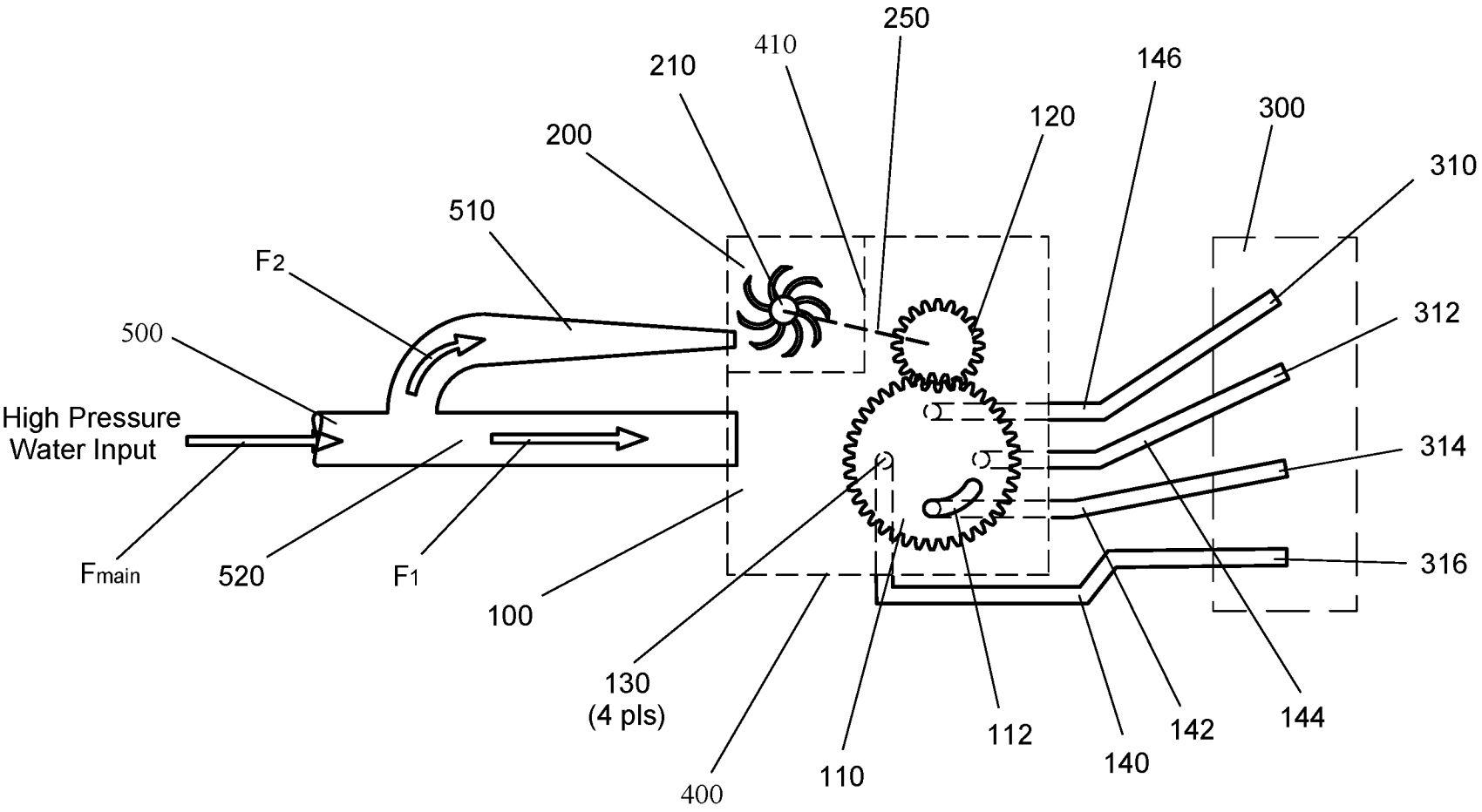
FIG. 1: is a schematic of the method of the present invention.

As described briefly above, the method and apparatus of the present invention provide a functional as well as economical solution for a variable pattern fountain display. Looking first at FIG. 1, a schematic representation of the present invention is shown. A bifurcated manifold 500 consists of a distribution plenum 520 and an impeller plenum 510. The distribution plenum 520 receives high-pressure water $F_{main}$ at its input. The actual pressure depends on the source of the water, but can be standard city pressure, for example 40 psi, or some other pressure from a dedicated pressure pump. While there is no specific pressure requirement, a general range of 20 to 60 psi is required to have sufficient energy to drive the gear mechanism discussed below. As will be recognized by those of skill in the art, high pressure water may be generated by a wide variety of methods including pumps, gravity, and air pressure to identify just a few, thus the scope of the invention is not limited to a single high pressure water source.

In one embodiment of the present invention, the bifurcated manifold 500 has a 0.75 inch diameter inlet. At a point approximately 0.5 inches from the inlet, the bifurcated manifold 500 splits, with the distribution plenum 520 continuing straight for approximately four inches and at a constant diameter of 0.75 inches.

At the same point approximately 0.5 inches from the inlet of the bifurcated manifold 500, the impeller plenum 510 branches off. The impeller plenum 510 has an initial diameter of approximately 0.75 inches, and a length of approximately four inches, but reduces to approximately 0.25 inches over the length of approximately four inches.

At an inlet pressure of 40 psi at bifurcated manifold 500 inlet, and assuming that the water velocity is approximately 1.5 inches per second, Bernoulli's equation results in a water velocity of approximately 13.5 inches per second at the outlet of impeller plenum 510. This increase in velocity provides the motive force to drive impeller 200 as discussed below.

Flow $F_1$ proceeds through the distribution plenum 520 to a distribution chamber 100 while flow $F_2$ proceeds through the impeller plenum 510 to the impeller chamber 200. Both distribution chamber 100 and impeller chamber 200 are contained in a common physical housing 400, but are separated by a pressure barrier 410. This separation is needed due to the pressure gradient between the water in the impeller chamber 200 and the water in the distribution chamber 100.

The pressure gradient between the impeller chamber 200 and the distribution chamber 100 exists due to an application of the Bernoulli's principle. The Bernoulli principle dictates generally that in a constricted envelope with differing entry and exit orifice areas, a non-compressible fluid stream will accelerate and lose pressure. At the same time, obeying Newton's second law of motion, as the non-compressible fluid accelerates, the force generated will increase. This increase in force drives the impeller 210, but since the pressure in the impeller chamber 200 is less than the pressure in the distribution chamber 100, the pressure barrier 410 must exist to isolate the two chambers.

Flow $F_1$ causes distribution chamber 100 to become pressurized to the input pressure in the absence of an outlet through one of a plurality of jet distribution orifices 130. In the embodiment shown in FIG. 1 there are four jet distribution orifices 130, but as will be obvious to those of skill in the art, any number of orifices could be present without departing from the spirit of the invention.

Driven gear 110 moves in response to driving gear 120. Driven gear 110 has a slot 112 near its outer perimeter. As driving gear 120 turns, the slot 112 in driven gear 110 passes over any one of the jet distribution orifices 130. When this occurs, water from the pressurized distribution chamber 100 passes through slot 112, through jet distribution orifice 130 and into jet distribution tube 142. Note that jet distribution tube 142 is only one of a plurality of jet distribution tubes 140, 142, 144 or 146. As will be recognized by those skilled in the art, any number of jet distribution tubes could be present without departing from the spirit of the invention.

In one embodiment of the present invention, the ratio of driving gear 120 teeth to driven gear 110 teeth is 1:4, such that for each rotation of the driving gear 120, the driven gear 110 advances ninety degrees. The slot dimension of the driven gear 110 covers approximately 80 degrees, thus for a four jet configuration, water passes to a particular jet for approximately a quarter cycle. Those of skill in the art will recognize that the slot could cover more or fewer degrees, changing the dwell time and thus the period that a given jet will be active.

In the embodiment shown a single slot 112 is present, however, it will be recognized by those of skill in the art that more than one slot could be present without departing from the spirit of the invention. For example, two slots 112 could be used at different locations on the driven gear 110 such that a given jet will be activated twice on any given cycle of the driven gear 110.

Jet distribution tubes 140, 142, 144 or 146 are connected to a jet manifold 300 containing a plurality of display jets 310, 312, 314, and 316. As will be known to those of skill in the art, more or fewer display jets could be used and remain within the scope of the invention. It will also be evident to those skilled in the art that jet manifold 300 could be collocated with the physical housing 400, be proximate to or be in a remote location from the physical housing 400 while remaining within the scope of the invention. Also evident is the fact that each of the display jets 310, 312, 314, and 316 and their associated jet distribution tubes 140, 142, 144 or 146 could be independent of each other, for example, going to a separate location on a fountain floor. This aspect of the present invention allows a broad spectrum of applications, thus is an advantage over other types of more restricted variable pattern generators.

Recall that a pressure barrier 410 exists between the distribution chamber 100 and impeller chamber 200. Contained within impeller chamber 200 is an impeller 210. Impeller 210 is driven by flow $F_2$ through impeller plenum 510. Impeller 210 is mechanically connected to driving gear 120 via shaft 250 such that as impeller 210 rotates in response to incoming water flow $F_2$, driving gear 120 turns as well. As discussed just above, driven gear 110 turns in response to the rotation of driving gear 120, causing slot 112 to rotate as well. In this way, the present invention provides a self-powered variable fountain jet display.

Figure 2A:
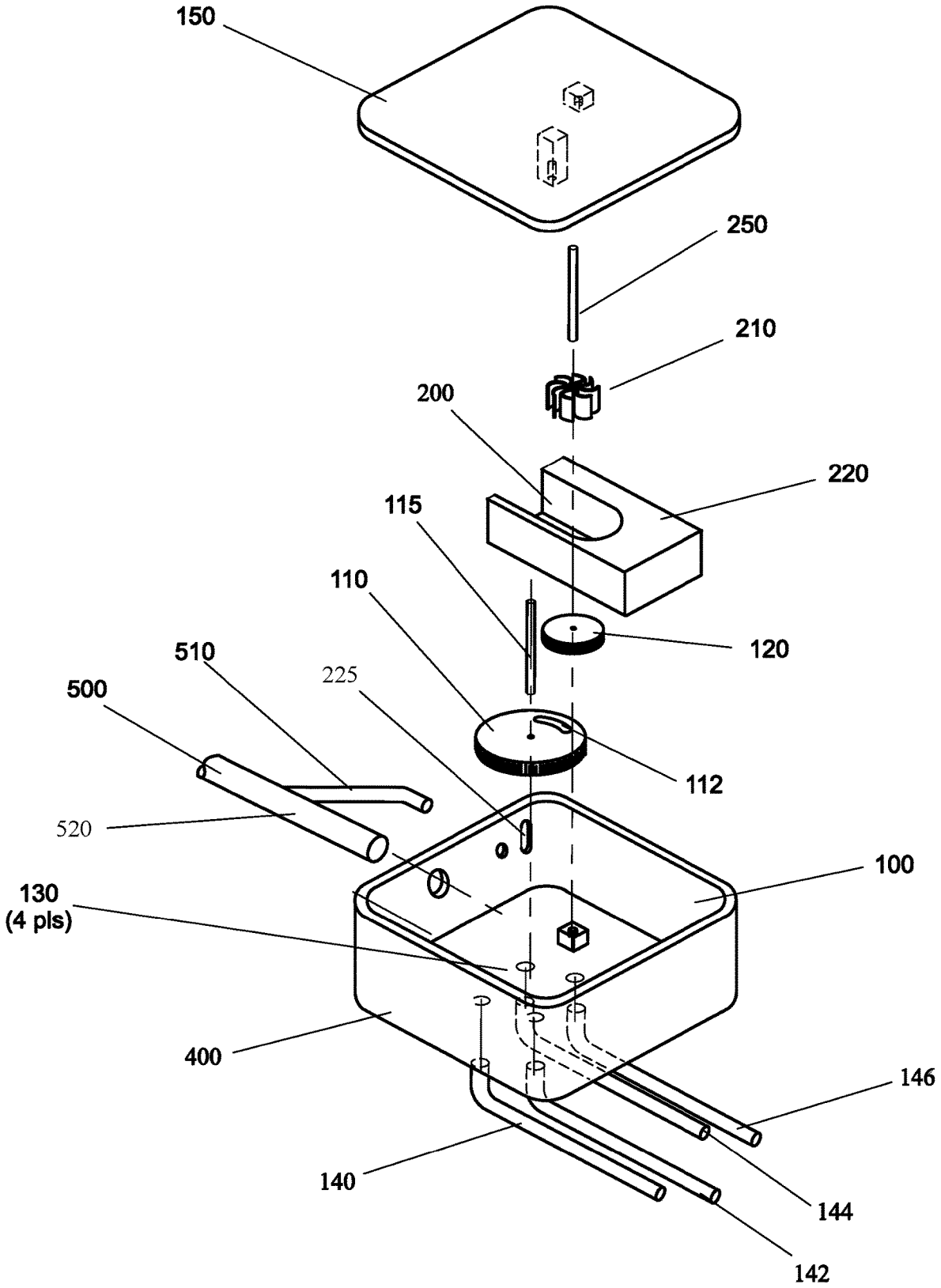
FIG. 2A: is an exploded view of a first embodiment of the apparatus of the present invention.

Turning now to FIG. 2A, an exploded view of a first, nonconfigurable embodiment of the apparatus of the present invention is shown. Physical housing 400 creates the distribution chamber 100. The bifurcated manifold 500 comprised of the distribution plenum 520 and the impeller plenum 510 attaches to physical housing 400 providing water inputs to the distribution chamber 100 and the impeller chamber 200. Impeller block 220 is used to form the impeller chamber 200 described above in conjunction with FIG. 1.

Impeller block 220 contains the impeller 210. An impeller shaft 250 provides mechanical linkage to driving gear 120 through a sealed hole in the bottom of impeller block 220. Because the hole in the bottom of the impeller block 220 is sealed, a pressure difference between the impeller chamber 200 and the distribution chamber 100 may be maintained.

Additionally, again due to the pressure difference between the impeller chamber 200 and the distribution chamber 100, the impeller chamber 200 has a separate exhaust port 225.

Returning to the physical housing 400, a driven gear 110 with a slot 112 is fixed in place by driven gear shaft 115. A top plate 150 is configured to provide fixed attachment points for both the driven gear shaft 115 and the impeller shaft 250. When the top plate 150 is tightly affixed to physical housing 400, both the distribution chamber 100 and the impeller chamber 200 are sealed to outside pressure. Four jet distribution orifices 130 are located in the bottom of the physical housing 400 such that when slot 112 on the driven gear 110 passes over any one of the distribution orifices 130, water passes from the distribution chamber 100 to one of a plurality of jet distribution tubes 140, 142, 144 or 146.

Figure 2B:
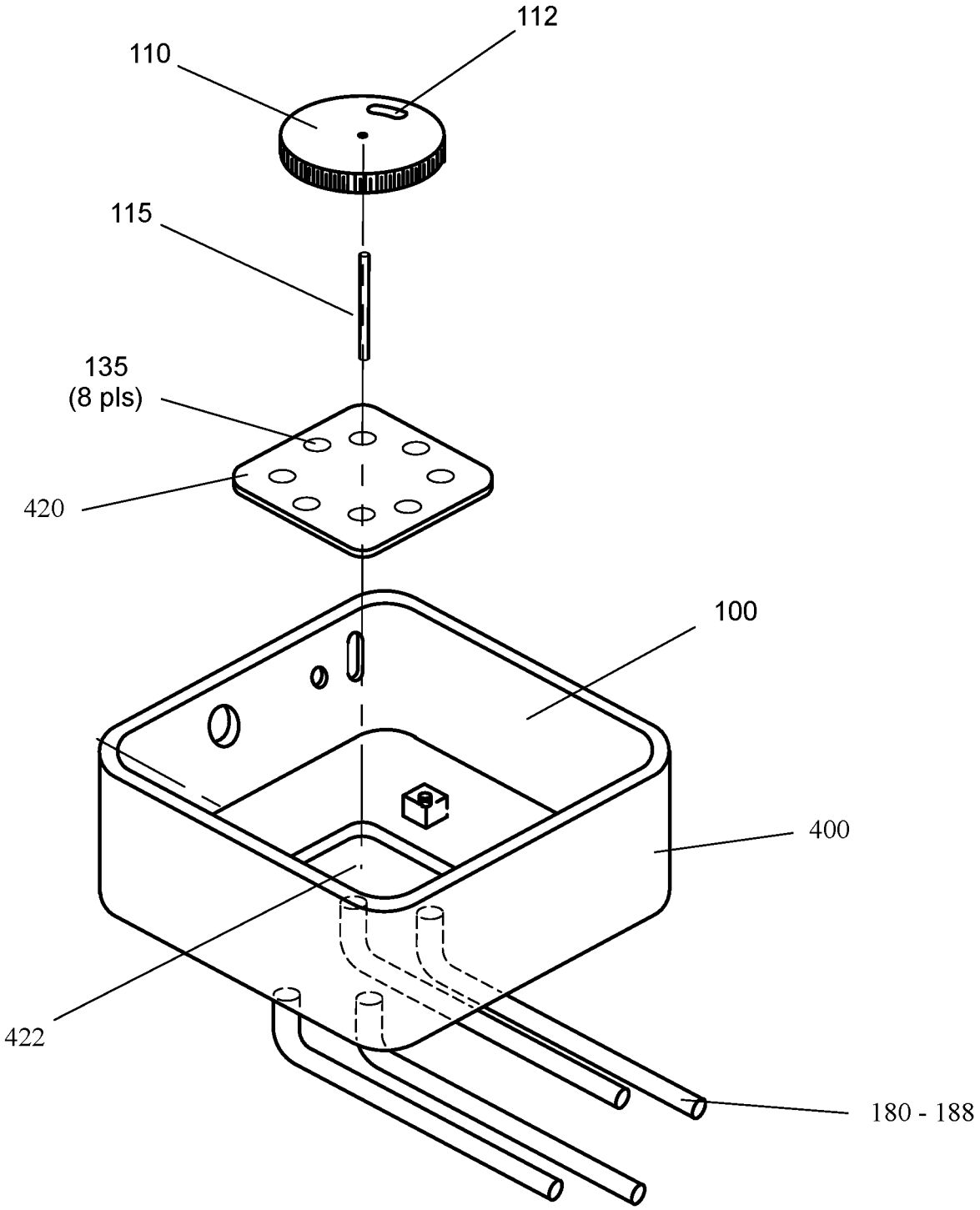
FIG. 2B: is an exploded view of a second embodiment of the apparatus of the present invention.

Looking now to FIG. 2B, an exploded view of a second, configurable embodiment of the apparatus of the present invention is shown. Note that only a portion of the apparatus is shown for clarity. It may be assumed that the balance of the apparatus is identical to the first embodiment discussed in detail in conjunction with FIG. 2A above.

In this second embodiment of the present invention, the physical housing 400 has an open space 422 in the bottom of the distribution chamber 100. The open space 422 is sized to accept orifice plate 420. Orifice plate 420 has a plurality of distribution orifices 135, in this specific example eight. It will be understood that more or fewer orifices could be provided without departing from the spirit of the invention.

The programmable orifice plate 420 is sealably attached to the bottom of physical housing 400. Driven gear shaft 115 and driven gear 110 perform the identical functions discussed in detail in conjunction with FIG. 2A above. It will be noted that in this second embodiment the slot 112 in driven gear 110 is reduced in size. This is required in order to avoid flow to multiple jet distribution tubes 180-188. [For clarity, only four of the eight jet distribution tubes 180-188 are shown].

Regarding the programmable orifice plate 420, it is possible to change the variable pattern display by changing the programmable orifice plate 420 to add or subtract distribution orifices 135 and associated jet distribution tubes 180-188. Moreover, by changing the configuration of the driven gear 110 and driving gear [120 in FIG. 2A], the timing of the variable pattern display may be changed. This programmable feature of the present invention is an advantage over contemporary, fixed pattern mechanisms.

The orifice plate 420 may be easily interchanged with alternate orifice plates thereby providing the programmable capability mentioned just above. The precise attachment mechanism for the orifice plate 420 is not discussed in detail, but it will be recognized by those skilled in the art that any attachment means could be used without departing from the spirit of the invention. By way of example, but not meant as a limitation, the attachment could be a slot-and-groove or a screw-and-seal method.

Figure 3A:
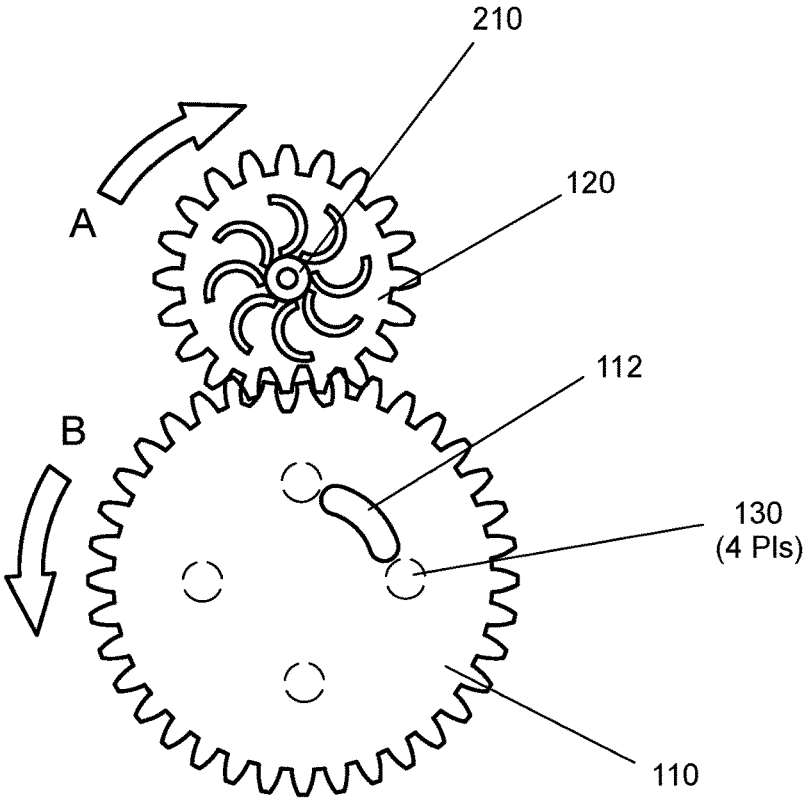
FIG. 3A: is a detailed view of the gear system of the present invention in a non-spouting condition.

FIG. 3 presents a detailed look at the gear timing for any embodiment of the present invention. Looking at FIG. 3A, a top view of the gear mechanism is shown. Driving gear 120 is mechanically connected to impeller 210 as described in conjunction with FIG. 2 above. As can be seen, driven gear 110 is meshed with driving gear 120 such that any motion imparted to driving gear 120 by impeller 210 will cause a counter motion in driven gear 110. It will be understood that the motion of impeller 210 is caused by the input water flow [$F_2$ in FIG. 1] through the impeller plenum 510 in FIG. 1.

In the state shown in FIG. 3A, the slot 112 is positioned between two of the distribution orifices 130. In this state there is no path for water from the distribution manifold [100 in FIG. 2] to pass through to any one of the jet distribution tubes [140, 142, 144 or 146 in FIG. 2]. As impeller 210 rotates in direction A, driven gear 110 rotates in direction B. This rotation continues until the slot 112 reaches the position shown in FIG. 3B.

Figure 3B:
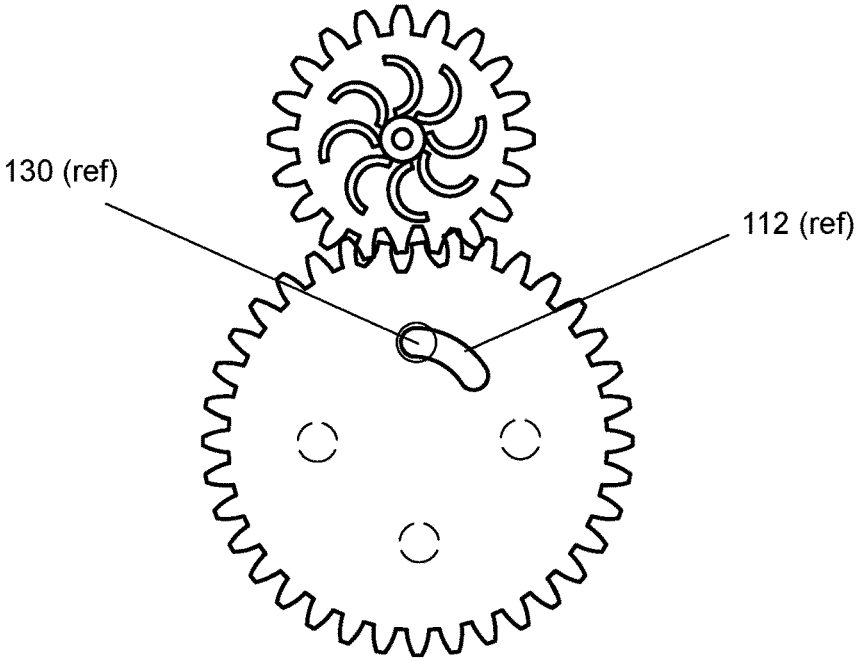
FIG. 3B: is a detailed view of the gear system of the present invention in a spouting condition.

FIG. 3B shows the state where slot 112 has just completely opened to one of the distribution orifices 130. At this point a path for water is available for flow to one of the jet distribution tubes [140, 142, 144 or 146 in FIG. 2] and its associated display jet. Flow will continue until slot 112 has completely passed the orifice, at which time the associated jet will discontinue its display. Each of the distribution orifices 130 is activated in turn as the driven gear 110 continues to rotate. In this way a plurality of display jets may be activated from the apparatus of the present invention. As will be known to those of skill in the art, more or fewer jets could be present without departing from the spirit of the invention.

A first advantage of the present invention is that it requires no external source of power in order to operate. The combination of the Bernoulli principle and Newton's second law of motion yield sufficient energy from the incoming water stream to drive an impeller and associated gear train. As the gear train rotates, one of a plurality of fountain jet displays is selected.

A second advantage of the present invention is that it is economical. All elements of the invention may be produced using inexpensive materials, thus making it desirable for mass consumer applications.

A third advantage of the present invention is that one embodiment of the present invention is configurable, or programmable. By changing the number of distribution jets and/or gear configurations, the display pattern can be varied over a very wide range, making the present invention useful for both home and commercial applications.

A fourth advantage of the present invention is that it is flexible. Each of the jet distribution tubes may be collocated or placed remotely from each other. This feature makes the present invention very desirable for different fountain configurations.

What is claimed is:

1. A method for providing a self-powered variable fountain display comprising:

a single source of high pressure water, said single source of high pressure water being delivered to a bifurcated manifold wherein a first plenum of said bifurcated manifold delivers high pressure water to a distribution chamber and a second plenum of said bifurcated manifold delivers high velocity water to an impeller chamber:

an impeller being driven by said high velocity water within said impeller chamber and being mechanically engaged to a driving gear within said distribution chamber:

a driven gear within said distribution chamber, said driven gear being engaged with said driving gear and having near its outer perimeter a slot, said slot passing water to one of a plurality of distribution orifices in response to rotation of said driving gear, and:

a single one of said plurality of distribution orifices passing water to a single one of a plurality of jet tubes such that as said slot passes over one of said distribution orifices said one of a plurality of said jet tubes delivers water to one of a plurality of fountain display jets causing the fountain display to vary over time.

2. The method of claim 1 wherein the input pressure of the bifurcated manifold is in the range of 20 to 40 psi.

3. The method of claim 1 wherein the ratio of said driving gear to said driven gear is 1:4.

4. The method of claim 1 wherein the slot covers 80 degrees.

5. The method of claim 1 wherein said distribution chamber has four distribution orifices.

6. The method of claim 1 wherein the bifurcated manifold has an inlet, a first outlet and a second outlet, said inlet having a diameter of approximately 0.75 inches, said first outlet having a diameter of approximately 0.75 inches and said second outlet having a diameter of approximately 0.25 inches such that water applied at said inlet at approximately 40 psi results in an increase in velocity of outlet water at said second outlet.

7. An apparatus for providing a self-powered variable fountain display comprising:

a housing having a distribution chamber and an impeller chamber, said distribution chamber passing high pressure water to one of a plurality of jet tubes via a slotted driven gear, said slotted driven gear being mechanically engaged with a driving gear coupled to an impeller contained within said impeller chamber, said impeller being driven by high velocity water:

a bifurcated manifold, said bifurcated manifold having a distribution plenum used to deliver high pressure water to said distribution chamber of said housing and an impeller plenum used to deliver high velocity water to said impeller chamber of said housing, and;

a jet distribution manifold, said jet distribution manifold having connected to it a plurality of jet tubes, each of said jet tubes directing water to one of a plurality of fountain display jets.

8. The apparatus of claim 7 wherein the impeller plenum and the distribution plenum are physically isolated from each other.

9. The apparatus of claim 7 wherein the jet distribution manifold is an integral part of said housing and has a fixed number of distribution orifices.

10. The apparatus of claim 7 wherein the jet distribution manifold is separate from said housing, said housing being capable of accepting a programmable orifice plate, said programmable orifice plate providing a plurality of distribution orifices.

11. The apparatus of claim 7 wherein said bifurcated manifold divides into a distribution plenum and an impeller plenum, said distribution plenum being approximately four inches in length and having an inlet opening of 0.75 inches in diameter and an outlet opening of 0.75 inches in diameter and said impeller plenum being approximately four inches in length and having an inlet opening of 0.75 inches in diameter and an outlet opening of 0.25 inches in diameter, both said distribution plenum and said impeller plenum having a common connection approximately 0.5 inches from the input of said bifurcated manifold.

12. The apparatus of claim 7 wherein the input water is supplied from city water.

13. The apparatus of claim 7 wherein the input water is supplied from a pump.

14. The apparatus of claim 7 wherein the driven gear has more than one slot.

15. The apparatus of claim 9 wherein said jet distribution manifold has four jet tubes.

16. The apparatus of claim 10 wherein said programmable orifice plate has more or fewer than four jet tubes.

17. The apparatus of claim 7 wherein said jet distribution manifold is collocated with said housing.

18. The apparatus of claim 7 wherein said jet distribution manifold is remotely located from said housing.

* * * * *